US006804943B2

(12) United States Patent
Kagi

(10) Patent No.: US 6,804,943 B2
(45) Date of Patent: Oct. 19, 2004

(54) RING TRAVELER AND METHOD FOR PRODUCING THE SAME

(75) Inventor: Jorg Kagi, Gibswil (CH)

(73) Assignee: Bracker AG, Pfaffikon-Zurich (CH)

( * ) Notice: Subject to any disclaimer, the term of this patent is extended or adjusted under 35 U.S.C. 154(b) by 0 days.

(21) Appl. No.: 10/030,065

(22) PCT Filed: Mar. 26, 2001

(86) PCT No.: PCT/CH01/00183

§ 371 (c)(1),
(2), (4) Date: Jun. 25, 2002

(87) PCT Pub. No.: WO01/83864

PCT Pub. Date: Nov. 8, 2001

(65) Prior Publication Data

US 2002/0162315 A1 Nov. 7, 2002

(30) Foreign Application Priority Data

May 3, 2000 (CH) ..... 0867/00

(51) Int. Cl.[7] ..... D01H 7/60
(52) U.S. Cl. ..... 57/120; 57/125

(58) Field of Search ..... 57/119, 120, 121, 57/122, 123, 124, 125, 126

(56) References Cited

U.S. PATENT DOCUMENTS

| | | | | | |
|---|---|---|---|---|---|
| 2,970,425 | A | * | 2/1961 | Foard | 57/119 |
| 4,308,715 | A | * | 1/1982 | Staehli | 57/119 |
| 4,677,817 | A | * | 7/1987 | Kanai | 57/125 |
| 4,885,905 | A | * | 12/1989 | Maruta et al. | 57/119 |
| 5,228,929 | A | * | 7/1993 | Panasiuk et al. | 148/232 |
| 5,753,052 | A | * | 5/1998 | Dajoux et al. | 148/217 |
| 6,568,164 | B2 | * | 5/2003 | Kusakari et al. | 57/119 |
| 2003/0087091 | A1 | * | 5/2003 | Seiki et al. | 428/364 |

* cited by examiner

*Primary Examiner*—John J. Calvert
*Assistant Examiner*—Shaun R Hurley
(74) *Attorney, Agent, or Firm*—Adams Evans P.A.

(57) ABSTRACT

The ring traveler (10) according to the invention has a noncoated core (20) which consists of iron material and which is provided with an, if appropriate, multipart nitrided edge layer (23; 24) at least in the region of the running surfaces (1) with which said core slides on a ring of a ring spinning or ring twisting machine.

15 Claims, 2 Drawing Sheets

RING TRAVELER AND METHOD FOR PRODUCING THE SAME

Figure 1A:
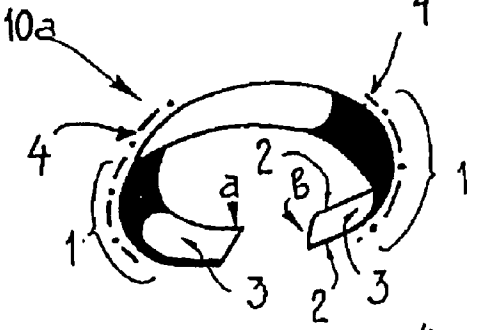

This application is a national stage application, according to Chapter II of the Patent Cooperation Treaty.

The invention relates to a method for producing a ring traveler for ring spinning or ring twisting machines and to a ring traveler as claimed in claims 1 and 7 respectively.

Ring travelers of ring spinning and ring twisting machines are moved at a high rotational speed (30 m/s to 50 m/s) on rings of the corresponding ring spinning or ring twisting machines. Both the contact surface between ring traveler and ring and the contact surface between ring traveler and thread are subjected to a high degree of wear. To increase production, however, increasingly higher running speeds of the ring travelers are required. By longer service lives being achieved, the costs are at the same time to be lowered.

It has been possible, in recent years, to improve the running and operating properties of ring travelers markedly by these being coated with appropriate materials. However, it has not been possible hitherto to improve the wear resistance at the thread passage.

U.S. Pat. No. 4,677,817 discloses a ring traveler having a ceramic layer which gives the ring traveler greater hardness and improved heat and corrosion resistance. This known ring traveler has markedly reduced operating costs due to the improved running and operating properties. However, the relatively high outlay in terms of production has an adverse influence on costing.

The object of the present invention is, therefore, to provide a ring traveler for ring spinning or ring twisting machines, which, on the one hand, has further-improved running and operating properties and, on the other hand, can be produced at a reduced outlay. A method for producing this ring traveler is also to be specified.

This object is achieved by means of a method and a ring traveler which have the features specified in claim 1 and claim 7 respectively.

A ring traveler according to the invention has a non-coated core which consists of iron material and which has an, if appropriate, multipart nitrided edge layer at least in the region of the running surfaces with which said core slides on a ring of a ring spinning or ring twisting machine or in which the thread is guided.

Instead of a layer, for example a ceramic or phosphate layer, being applied to the core and, if appropriate, being remachined, at considerable outlay, said core is subjected, at least partially, to a nitriding treatment, during which heat energy and a nitriding agent as active medium are supplied to the core.

Embrittlement and a considerable reduction in the elasticity of the treated material are known to occur during nitriding treatment. By the composition of the nitriding agent being controlled according to the invention and by an appropriately selected treatment time, the elasticity of the ring traveler, which is necessary so that the latter can be attached, free of deformation, onto spinning rings, can be maintained.

The core is heated to a temperature in the range of 450° C.–600° C., preferably to a temperature close to 550° C., and is maintained in said temperature range for 3–60 hours, preferably for about 24 hours. The nitriding agent may be supplied in the form of a gas, liquid or plasma preferably consisting of $NH_3$ and $N_2$ components. Regions in which nitriding treatment is not to take place are, for example, covered.

The nitrided edge layer of the ring traveler core consists of a connecting layer without an additional diffusion layer, of a connecting layer with an additional diffusion layer lying radially on the inside or only of a diffusion layer. The connecting layer has preferably a thickness of 0.1 $\mu$m–30 $\mu$m and the diffusion layer a thickness of 1 $\mu$m–2000 $\mu$m.

Preferably, the active medium has, in addition to the nitrogen components, sulfur components and/or carbon components. By sulfur components and/or carbon components being admixed, the coefficient of friction can be reduced. At the same time, the thicknesses of the connecting layer and of the diffusion layer can be coordinated, as required.

When small thicknesses of the connecting layer are selected, only slight variations in the roughness of the core surface are obtained.

In preferred refinements of the invention, the surface of the ring traveler is additionally polished before and/or after the nitriding treatment. Ring travelers exposed to high chemical stress are preferably reoxidized.

In so far as a core made from a heat-treated steel is used, only negligibly small changes in dimension occur during the nitriding treatment.

The ring travelers according to the invention have substantially improved operating properties, in particular an increased traveler service life and increased indentation resistance at the thread passage. The functionally very important indentation resistance in the thread passage with a mechanical and/or chemical load was improved by 50%–200%, thus resulting in an improvement in the quality of the processed yarn. Furthermore, by virtue of the increased chemical resistance, yarn contaminations due to corrosion products which previously occurred during the processing of revived and chlorine-containing fibers are avoided. Moreover, because of the good sliding properties, no or only slight fiber lubrication is required.

Furthermore, the ring travelers can be produced at lower outlay and adapted to individual requirements which may possibly arise.

Ring travelers according to the invention may be used both in spinning mills and in twisting mills. Their good running properties, such as, for example, good sliding and low wear, are implemented particularly advantageously in cooperation with steel rings, but they may also be used on other rings, such as, for example, on sintered, burnished or coated rings.

Figure 2:
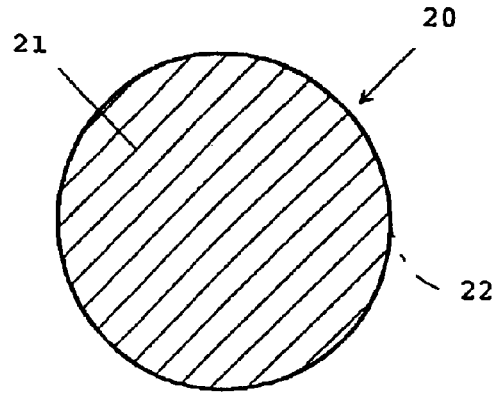
Figure 3:
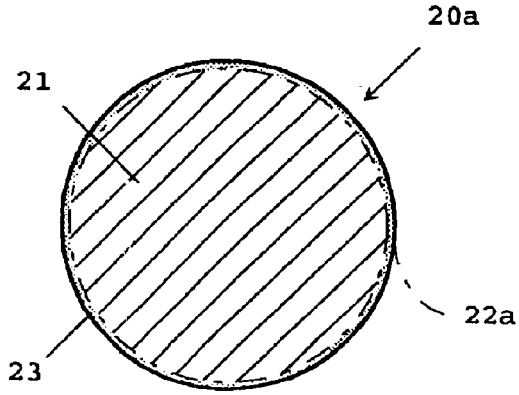
Figure 4:
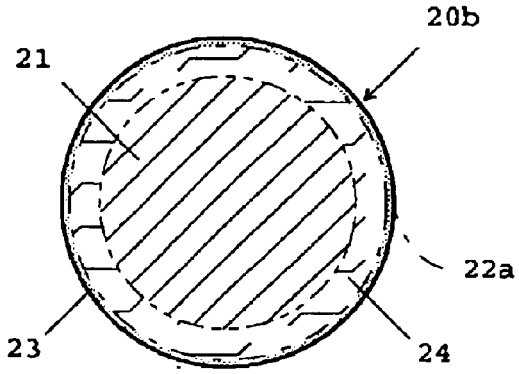
Figure 5:
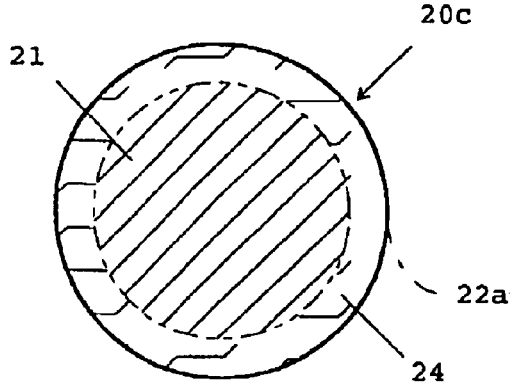

The ring traveler according to the invention is explained in more detail below with reference to exemplary embodiments shown in the purely diagrammatic drawings in which:

FIGS. 1*a*–1*f* show various embodiments of ring travelers,

FIG. 2 shows a section through the core of a ring traveler before the processing of the latter and FIGS. 3–5 show a section through the core of ring travelers after the processing according to the invention.

Figure 1B:
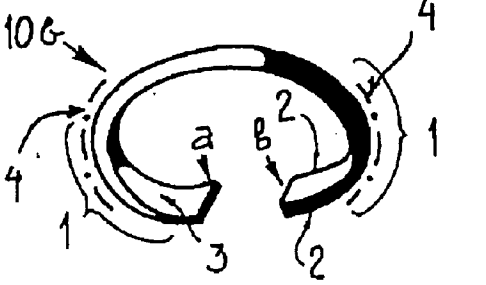
Figure 1C:
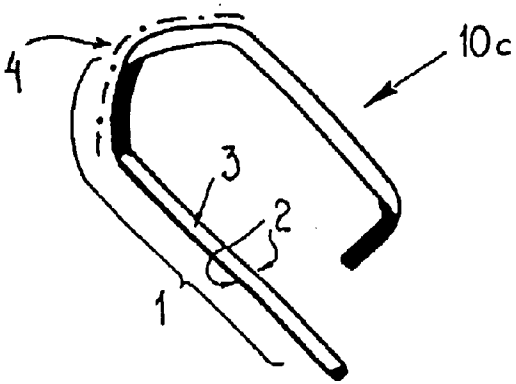
Figure 1D:
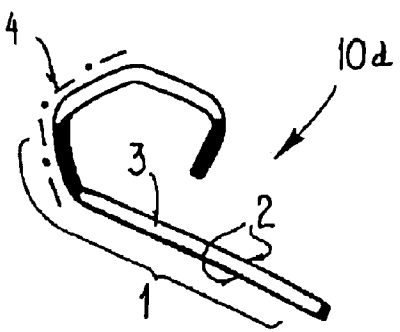
Figure 1E:
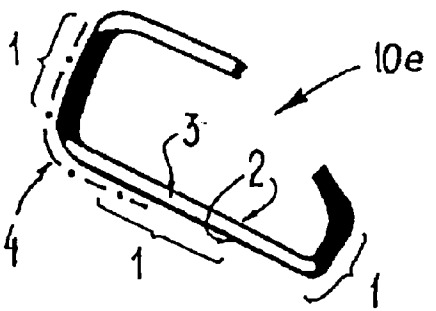
Figure 1F:
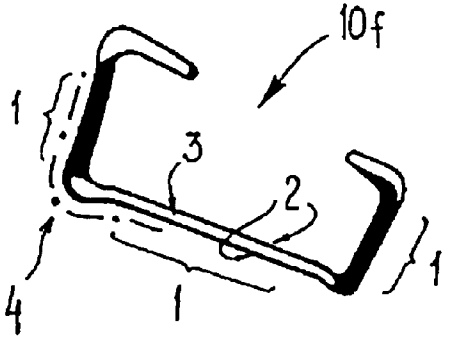

FIGS. 1*a* to 1*f* show ring travelers 10*a*, . . . , 10*f* in various embodiments already described in WO 99/49113. FIGS. 1*a* and 1*b* show C-shaped ring travelers 10*a*, 10*b*, such as are used typically on T-flanged rings of ring spinning or ring twisting machines. By contrast, FIGS. 1*c* to 1*f* show ear-shaped and hook-shaped ring travelers 10*c*, . . . , 10*f*. The ring travelers 10*c* and 10*d* are used on oblique-flanged rings, the ring travelers 10*e* on flanged rings running conically and the ring travelers 10*f* on flanged rings running vertically.

Those regions of the ring travelers 10*a*, . . . , 10*f* which, during operation, form the running surfaces sliding on the flanged rings are identified in each case by 1. In the case of the C-shaped ring travelers 10*a*, 10*b*, because of their symmetric configuration both flanks a, b serve as running surfaces. In the case of the ear-shaped or hook-shaped ring travelers 10*c*, . . . , 10*f*, the region 1 of the running surfaces is clearly determined by the shape.

Ring travelers 10 or 10*a*, . . . , 10*f* according to the invention may be produced in the embodiments shown in FIG. 1*a*, . . . , if or in any other desired embodiments.

A ring traveler 10 according to the invention has a noncoated core 20 which consists of iron material and which has a nitrided zone at least in the region 1 of the running surfaces with which it slides on a ring of a ring spinning or ring twisting machine, or in the region in which the thread is guided. The thread passage is located, in this case, in those regions of the ring travelers 10*a*, . . . , 10*f* which are designated by 4.

For this purpose, the ring traveler 10 is subjected, at least partially, to nitriding treatment, during which heat energy and a nitriding agent as active medium are supplied to the core 20. In order to achieve as smooth surfaces as possible after the nitriding treatment, the ring traveler 10 is polished preferably before the nitriding treatment.

The basic material of the core 20 is preferably an unalloyed or low-alloy steel, preferably a nitriding steel. Preferably, a core 20 consisting of a heat-treated steel is selected, in which only negligibly small changes in dimension occur during the nitriding treatment. Furthermore, the basic material of the core 20 preferably contains nitride-forming elements, such as chromium, vanadium, aluminum, molybdenum, manganese and/or nickel.

In addition to the choice of raw material (for example, heat-treated steel), the process parameters, such as the temperature profile (ramp profile of the heating, holding time and holding temperature, ramp profile of the cooling) and the composition of the nitriding agent influence the result of the nitriding treatment.

The core is heated in a furnace to a temperature in the range of 450° C.–600° C., preferably to a temperature close to 550° C., and is maintained within said temperature range for 3–60 hours, preferably for about 24 hours. The nitriding agent may be supplied in the form of a gas, liquid or plasma preferably consisting of $NH_3$ and $N_2$ components and, if appropriate, also having $H_2$. In the case of the plasma treatment, during which preferably pure nitrogen $N_2$ is used as the nitriding agent, nitrogen atoms are ionized in an evacuated chamber, after which they are attracted by the oppositely polarized surface 22 of the ring travelers 10 and bond with the iron to form iron nitride.

Ring travelers 10 treated according to the invention preferably have, after treatment, a surface 22*a* with a black, blue, yellow or white gloss.

Preferably, the active medium has, in addition to nitrogen components, sulfur components and/or carbon components. As a result, on the one hand, the coefficient of friction can be reduced and, at the same time, the formation of the nitrided zones can be influenced.

By virtue of the nitriding treatment described, an, if appropriate, multipart nitrided edge layer is formed in the core 20 of the ring traveler 10 and is explained in more detail with reference to FIGS. 2 to 5.

FIG. 2 shows a section through the core 20 of an untreated ring traveler 10. It is clear that there is an unchanged basic material 21 over the entire core cross section.

FIG. 3 shows a section through the core 20*a* of a treated ring traveler 10, which has a thin edge layer consisting of nitrided basic material and designated as a connecting layer 23, in which substantial diffusion saturation has occurred.

FIG. 4 shows a section through the core 20*b* of a more intensively treated ring traveler 10, which has a connecting layer 23 and, below the latter, a further layer which consists of nitrided basic material and which is designated as diffusion layer 24. Nitrogen-enriched mixed crystals and precipitated nitrides are contained in the diffusion layer 24.

FIG. 5 shows a section through the core 20*c* of a treated ring traveler 10, which has only a diffusion layer 24 and no connecting layer 23.

The choice of the layer makeup is made according to the requirement profile for the ring traveler 10. A hard connecting layer is preferably provided for ring travelers 10 with high running speeds. Preferably only a relatively tough and yet relatively hard diffusion layer 24 is selected for ring travelers 10 which are exposed to relatively high forces, with a connecting layer being avoided.

The connecting layer preferably has a thickness of 0.1 μm–30 μm and the diffusion layer a thickness of 1 μm–2000 μm. The use of a connecting layer with a thickness of 8 μm–12 μm and a diffusion layer with a thickness of 100 μm–200 μm is particularly advantageous. By a small thickness being selected or by the connecting layer being avoided completely, material fractures can be prevented, which have hitherto made it impossible to employ this technology in this sector.

The layer thicknesses occurring as a result of nitriding treatment depend greatly on the steel composition and on the surface state of the untreated ring travelers 10. Basically, a thick connecting layer is achieved in the case of a high nitrogen content and high temperatures and a thin connecting layer is achieved in the case of a low nitrogen content and low temperatures. The layer thicknesses or the diffusion depths depend, at the same time, on the treatment duration.

Moreover, fine lightweight ring travelers 10 are treated for a shorter duration than coarse heavy ring travelers 10.

By sulfur components and/or carbon components being admixed, the coefficient of friction can be reduced. At the same time, the thicknesses of the connecting layer and of the diffusion layer can be coordinated, as required.

If small thicknesses of the connecting layer are selected, only slight variations in the roughness of the core surface 22 occur, so that subsequent polishing of the running surfaces can be avoided. Embrittlement of the core material is also avoided.

For optimizing the ring traveler 10, in preferred refinements of the invention, the surface 22; 22*a* of the core 20; 20*a* is polished before and/or after the nitriding treatment.

Ring travelers 10 exposed to high chemical stress are preferably reoxidized.

In the region of the running surface 1, primarily an inner face, designated by 3, of the ring traveler 10 must, of course, be wear-resistant and equipped with good sliding properties and therefore have a nitrided layer 23; 24. The result of corresponding thread tension may be that the ring traveler 10 runs along, tilted laterally, on a ring, so that it may prove advantageous also to provide both end faces 2 with a nitrided layer 23; 24.

The nitriding treatment is preferably carried out for the entire ring traveler 10, although it is also possible to provide only the mechanically and/or chemically highly stressed regions with a nitrided edge zone.

What is claimed is:

1. A method for producing a ring traveler (10) for ring spinning or ring twisting machines, which has a core (20) consisting of iron material, and comprising the step of subjecting at least a portion of the core (20) to a funding treatment during which heat energy and a nitriding agent as active medium are supplied to the core (20), wherein the method includes the step of oxidizing the core (20) after the nitriding treatment.

2. The method as claimed in claim 1, wherein the core (20) is heated to a temperature in the range of 450–600° C.

3. The method as claimed in claim 2, wherein the core (20) is maintained in said temperature range for 3–60 hours.

4. The method as claimed in claim 1, 2, or 3, wherein the nitriding agent is supplied in the form of a gas comprising $NH_3$ and $N_2$ components, a nitrogen-enriched liquid or a nitrogen-enriched plasma.

5. The method as claimed in claim 1, wherein the active medium includes components selected from the group consisting of sulfer components and carbon components.

6. The method as claimed in claim 1 wherein method includes the step of polishing the core (20) before the nitriding treatment.

7. The method as claimed in claim 1, wherein method includes the step of polishing the core (20) after the nitriding treatment.

8. A ring traveler (10) for ring spinning or ring twisting machines, comprising an iron core (20) wherein at least one mechanically stressed part of the core (20) has a nitrided edge layer (23, 24), and wherein the edge layer (23, 24) includes a connecting layer (23) and a diffusion layer (24), whereby the connecting layer (23) has a thickness of 8 μm–12 μm and the diffusion layer (24) has a thickness of 100 μm to 200 μm.

9. A ring traveler (10) according to claim 8, wherein the mechanically stressed part of the core (20) comprises a running surface for the thread.

10. A ring traveler (10) according to claim 8, wherein the mechanically stressed part of the core (20) comprises a surface running on the ring of the spinning or twisting machine.

11. The ring traveler (10) as claimed in claim 8 wherein the connecting layer (23) contains components selected from the group consisting of sulfur and carbon.

12. The ring traveler (10) as claimed in claim 8, wherein the surface (22) of the core (20) is polished and/or is provided with an oxide layer.

13. The ring traveler (10) as claimed in claim 12, wherein the surface (22) of the core (20) is black, blue, yellow or white.

14. The ring traveler (10) as claimed in claim 8, wherein the basic material (21) of the core (20) is nitriding steel.

15. The ring traveler (10) as claimed in claim 8, wherein the basic material (21) of the core (20) contains a nitride-forming element selected from the group consisting of chromium, vanadium, aluminum, molybdenum, manganese and nickel.

* * * * *